US007540693B2

(12) United States Patent
Gross et al.

(10) Patent No.: US 7,540,693 B2
(45) Date of Patent: Jun. 2, 2009

(54) METHOD FOR PILLAR RECOVERY IN CHAMBER-AND-PILLAR WORKING AND TUBBING UNIT FOR PILLAR RECOVERY

(75) Inventors: Peter Gross, Überherrn (DE); Reiner Schuster, Saarbrücken (DE)

(73) Assignee: DBT GmbH (DE)

( * ) Notice: Subject to any disclaimer, the term of this patent is extended or adjusted under 35 U.S.C. 154(b) by 0 days.

(21) Appl. No.: 11/509,521

(22) Filed: Aug. 24, 2006

(65) Prior Publication Data

US 2007/0046094 A1 Mar. 1, 2007

(30) Foreign Application Priority Data

Aug. 24, 2005 (DE) ..... 10 2005 040 272

(51) Int. Cl.
*E21C 41/00* (2006.01)
*E21D 15/44* (2006.01)

(52) U.S. Cl. ..... 405/301; 405/290

(58) Field of Classification Search ..... 405/290, 405/299, 300, 301, 291
See application file for complete search history.

(56) References Cited

U.S. PATENT DOCUMENTS

| | | | | | |
|---|---|---|---|---|---|
| 3,328,966 | A | * | 7/1967 | Creuels et al. | 405/300 |
| 3,505,823 | A | * | 4/1970 | Bell | 405/301 |
| 3,855,802 | A | * | 12/1974 | Alacchi | 405/297 |
| 3,892,100 | A | * | 7/1975 | Jamison | 405/291 |
| 4,026,118 | A | * | 5/1977 | McCay, Jr. | 405/291 |
| 4,143,991 | A | * | 3/1979 | Stafford | 405/291 |
| 5,584,611 | A | * | 12/1996 | Clonch | 405/299 |

FOREIGN PATENT DOCUMENTS

| | | |
|---|---|---|
| DE | 30 09 923 A1 | 3/1980 |
| DE | 32 38 256 A1 | 10/1982 |

* cited by examiner

*Primary Examiner*—John Kreck
(74) *Attorney, Agent, or Firm*—Baker & McKenzie LLP

(57) ABSTRACT

Methods for pillar recovery in chamber-and-pillar working materials in underground stratified beds are disclosed. Additionally, tubbing units for pillar recovery in chamber-and-pillar working of materials in underground stratified beds are disclosed. An extraction device is aligned obliquely to pillar galleries located between the pillars and the roof is supported in front of the retreat face of the extraction device with a plurality of tubbing units, each tubbing unit being adjustable in height and width and movable through operation of a vehicle. The tubbing units may be moved through other tubbing units that are set, and reset in another position.

12 Claims, 5 Drawing Sheets

METHOD FOR PILLAR RECOVERY IN CHAMBER-AND-PILLAR WORKING AND TUBBING UNIT FOR PILLAR RECOVERY

CROSS-REFERENCE TO RELATED APPLICATION

This application claims priority to German Patent Application No. 10 2005 040 272.0 filed on Aug. 24, 2005.

The invention relates to a method for pillar recovery in the extraction of minerals and raw materials in underground stratified beds in chamber-and-pillar working, with a retreat section which extends over a plurality of pillars separated from each other by transverse pillar galleries running transversely and by longitudinal pillar galleries running longitudinally, and whose work face is worked between two outer transverse pillar galleries with an extraction device that has a rotary-cutting or cutting operation in long face working or short face working. The invention also relates to a tubbing unit for pillar recovery in the chamber-and-pillar working of minerals and raw materials in underground stratified beds, which unit can be arranged in a pillar gallery between two pillars, can be displaced to a different position and has a means of support that is vertically adjustable by means of props and can be pressed against the roof for the purpose of supporting the roof.

In the underground extraction of stratified minerals and raw materials, such as coal and salt in particular, longwall working on the one hand and chamber-and-pillar working on the other are used as traditional extraction methods. Unlike longwall working, the roof is supported in chamber-and-pillar working by the natural standing pillars for keeping open the cavities created by and required for mining, and further support is provided by anchor propping in the worked chambers and driven up pillar galleries. Because of the natural pillars left standing by the system there are necessarily considerable working losses, depending on the required pillar dimensioning. These working losses may amount to as much as 60% of the workable total deposits of minerals or raw materials. On the other hand, chamber-and-pillar working is characterized by high production efficiency at relatively low investment costs, very high operative flexibility and the low degree of organization required, a particular advantage of chamber-and-pillar working being the relatively simple control of the rock mechanics. In chamber-and-pillar working bed-specific factors, such as total deposits, extension and distribution of deposits and frequency of disturbance of the beds are far less significant than in long face or short face longwall working. In chamber-and-pillar working a method is also known for consistently improving the total degree of utilization by recovering the raw materials and minerals contained in the pillars by working the pillars in a second extraction stage, so-called pillar recovery or re-pillaring, and the invention relates to this area of chamber-and-pillar working.

A generic method for pillar recovery is disclosed in DE 30 09 923 A1. In the known method, the retreat section in long face working is extracted with a work face running in an arc shape, using rotary-cutting or cutting extraction devices in which the extraction device, running in a curved shape, as is normal in long face working, is supported and pushed with hydraulic shield supports. However, since a relatively high curvature of the conveyor of the long face extraction device on which the extraction machine is guided is required, the industrial use of this method presents problems. Working or driving through the open pillar galleries, with roof control, could also cause serious problems, with the result that a sufficiently high production output could not be achieved with the known method.

DE 32 38 256 A1 discloses, by way of example, tubbing units for pillar recovery consisting of a plurality of hydraulic tubbing frames connected together, which frames are driven and moved by chain or caterpillar tracks. The known tubbing units have a cover that can be pressed against the roof, each cover extending over the width of one of the tubbing frames.

The object of the invention is to provide a method for pillar recovery and tubbing units for this purpose with which a high production output can be achieved in pillar recovery at the lowest possible technical expenditure for the available equipment, using short face or long face extraction devices known from longwall working.

This and other objects are achieved, in their aspect according to the method of the invention, in that the extraction device is aligned obliquely to the longitudinal pillar galleries, whereby the retreat face leads the entire remaining retreat at face one of the outer transverse pillar galleries, and in that the roof is supported in the working direction, in front of the retreat face and in front of the extraction device, by a plurality of displaceable tubbing units arranged between the pillars in the pillar galleries. The solution according to the invention is based on an oblique alignment of the extraction device engaged in long face working or short face working, which device is supported by a preferably systematic support of the open pillar gallery system of the longitudinal pillar galleries and transverse pillar galleries in front of the work face. Here the retreat face extends over approximately two to four pillars, depending on the dimensioning (length and width) of the pillars. According to the invention the work face therefore always extends only over a partial area of the extent of all the underground pillar galleries in the bed. The pushing of an extraction device running obliquely to the longitudinal pillar galleries can be controlled much more easily than the pushing of an extraction device arranged in a curved shape.

In the method according to the invention at least two tubbing units per pillar are preferably arranged in the longitudinal pillar galleries and at least one tubbing unit per pillar is preferably arranged in each inner transverse pillar gallery, which are reversed should system conditions require this. It is particularly advantageous if three to five tubbing units per pillar are arranged in the longitudinal pillar galleries and one tubbing unit is arranged in each inner transverse pillar gallery. Preference is given to the use of semi-mobile tubbing units which do not have their own drives but which are displaced by means of a vehicle which has, for example, a loading platform, a lifting device, a grab or the like for temporarily receiving, conveying and depositing the tubbing units. Tubbing units, preferably with relatively little engineering, are therefore used to support the roof in the direction of working, in front of the retreat face. To allow displacement in the method according to the invention it is particularly advantageous for the tubbing units to be retractable both in height and width. It is particularly advantageous for the tubbing units to be designed so that the retracted tubbing units can be moved through extended and set tubbing units, i.e. tubbing units supporting the roof, with the vehicles during displacement. This has the added advantage that accidental loosening of the roof strata due to frequent loading and unloading of tubbing units is avoided, since it is not necessary to rob and displace a tubbing unit that is already set in the pillar gallery in order to set another tubbing unit in essentially the same place later. Instead a tubbing unit, once set, can remain in its setting position until it has to be displaced in any case, for working the next pillar, due to the progress of the work.

To achieve the above-mentioned object the invention proposes tubbing units in which the means of support has two support beams that are arranged at a certain distance from each other and can be moved relative to each other and are independent of each other to a limited degree, each of which beams is supported by means of two props and a steering gear arranged between the props on a floor runner. Here a transfer frame is arranged between the support beams, to which frame at least one of the support beams is movably secured for remote adjustment of the support beams by means of intermediate guides, and the tubbing unit can be conveyed with a vehicle so that tubbing units that are not set can be moved with the vehicle. During conveyance the tubbing unit can preferably be supported by the transfer frame on the vehicle or gripped by it. Due to the remote adjustment of the support beams it is possible that during the displacement of a tubbing unit other tubbing units supporting the roof can remain set. The remote adjustment of the support beams should be sufficient for a tubbing unit, when folded or contracted, i.e. when the tubbing unit is reduced in height and width, to be conveyed with the vehicle between the floor runners of a set tubbing unit and the tubbing unit expanded to its full width.

In an embodiment of the invention the support beam can be moved by means of telescopic intermediate guides, constructed as adjusting cylinders, in a linear movement. In an alternative embodiment the intermediate guides can be swiveled on the transfer frame and the support beam. In this embodiment it is particularly advantageous for a hydraulically adjustable adjusting cylinder to be arranged between one of the intermediate guides and the transfer frame in order to be able to effect the inward folding or collapse and unfolding of the support beams and floor runners of the tubbing units by simple hydraulic means. It is particularly appropriate if the intermediate guides can be swiveled by means of the adjusting cylinder between a first swivel position, in which the adjusting cylinder and the support beam lie parallel with the longitudinal side of the transfer frame, and a second swivel position in which the support beam is laterally extended and the intermediate guide stands at an angle to the longitudinal side of the transfer frame. In certain applications it may be sufficient for only one of the two support beams to be movable or swiveled. In the preferred embodiment, however, both support beams can be moved and swiveled by intermediate guides on the transfer frame.

A particularly simple design of the tubbing units may be obtained when the props and/or the adjusting cylinders can be connected to longwall hydraulics of a long face or short face extraction device used in pillar recovery and/or to the hydraulics of a hydraulic unit mounted on the vehicle. In this embodiment the tubbing units are therefore passively adjustable and do not have their own drive or their own hydraulic unit, but must be connected either to the longwall hydraulics or to a hydraulic unit mounted on the vehicle to enable the tubbing units to be set and the adjusting cylinders to be extended and/or contracted. Also in preference, the connection joints of the intermediate guides on the support beam side are arranged on plummer blocks which are secured tiltably to the associated support beam for variable vertical adjustment of the two support beams. In this embodiment the two support beams can be extended to different heights. The steering gears guiding the movement of the support beams are suitably designed as lemniscate gears and/or the swiveled intermediate guides are designed as parallel steering gears. The lemniscate gear ensures that the support beams can only be extended parallel with the associated floor runner against which the props abut, and the parallel steering gear ensures that the support beams can be swiveled in parallel and uniformly on the transfer frame between both support beams, which frame is not normally loaded with the roof load during operation. Here it is particularly advantageous for the upper side of the support beams to be higher than the upper side of the transfer frame.

The underside of the transfer frame may have a guide or support for the loading platform of the vehicle to enable the tubbing unit to be deposited on the loading platform of a vehicle by sliding the transfer frame underneath it, thus achieving optimum depositing of the tubbing units on the loading platform of the vehicle with which the tubbing units are then moved. Alternatively the transfer frame of the tubbing unit may also be provided with engaging means or engaging pockets or the like for a lifting device or grab device carried on the vehicle.

Further advantages and embodiments of the invention are detailed in the following diagrammatic description of exemplary embodiments according to the invention shown in the drawing, where:

FIGS. 1, 2, 3 each show, in an elevation of a bed worked by the chamber-and-pillar method, the process involved in the pillar recovery according to the invention;

Figure 1:
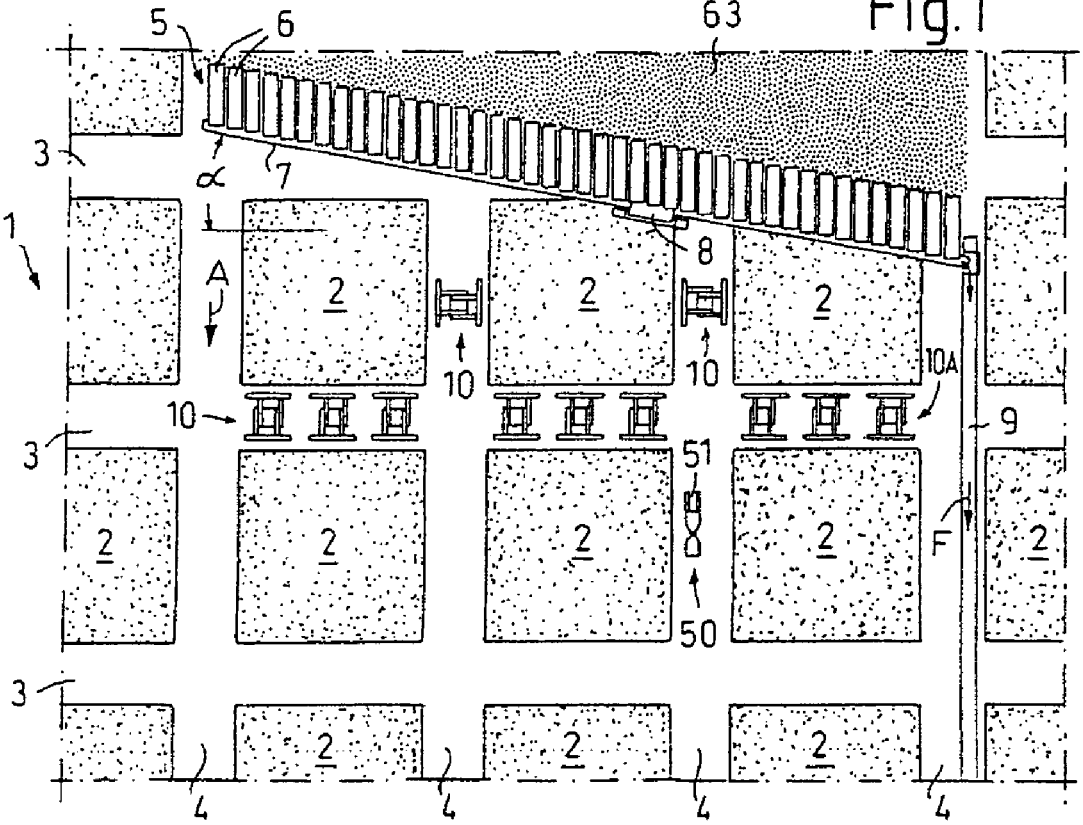
Figure 2:
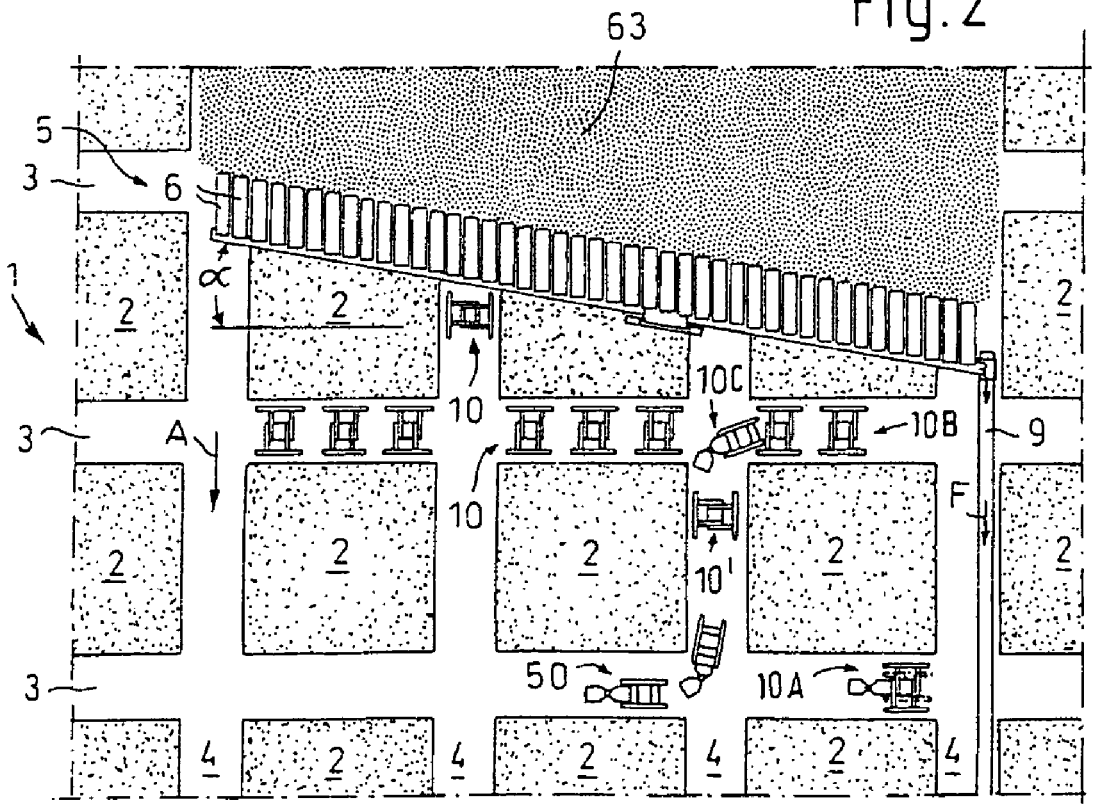
Figure 3:
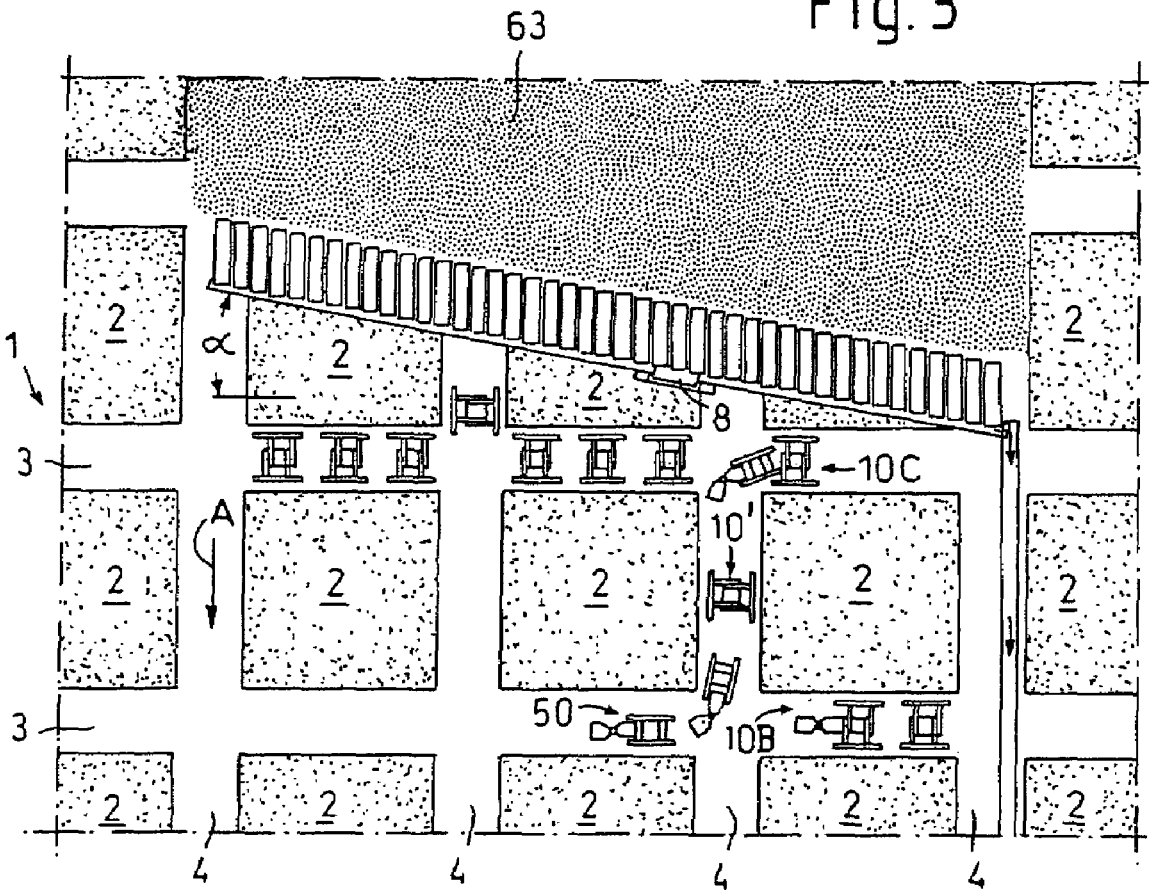

In FIGS. 1 to 3 an underground coal seam and another underground mineral bed are generally denoted by the reference number 1, which seam or bed has been worked by a chamber-and-pillar method of prior art, and which has a multiplicity of pillars 2 left standing between the roof and floor, between which longitudinal pillar galleries 3 running longitudinally and at right angles to each other and transverse pillar galleries 4 running transversely have been raised. These may be 6 m wide, for example, with pillar dimensions of 18 m in the longitudinal direction and transverse direction, for example.

Pillars 2 are recovered in the exemplary embodiment shown in the advancing or retreat face in short face working in working direction A with an extraction device generally denoted by reference number 5, which device, in a manner intrinsically known in longwall working, comprises a multiplicity of electrohydraulic tubbing frames 6 arranged adjacent to each other, by means of which frames the working longwall is kept open on the work face, and a conveyor trough 7, on which is guided, for example, a drum-cutter loader 8 traveling backwards and forwards between both ends of the short face extraction device 5, is pushed in working direction A. Extraction device 5 extends over a retreat face of three pillars 2, in the exemplary embodiment shown, and the changes of direction for conveyor 7, with the drive devices not shown, are each arranged in an outer transverse pillar gallery 4. In the case of a retreat face extending over three pillars 2, two further, inner transverse pillar galleries 4 lie between the two outer transverse pillar galleries 4. As is known per se, the material extracted on the retreat face on pillars 2 is transferred by longwall conveyor 7 to a drift conveyor 9, which is laid in one of the two outer transverse pillar galleries 4. The direction of conveyance is denoted by reference letter F. To the side of both outer transverse pillar galleries 4 there are further pillars 2, with pillar galleries 3, 4, which will be worked at a later stage, and the roof falls in behind the extraction device as thrust 63.

According to the invention, extraction device 5 is arranged at an angle α, preferably of approx. 10°, obliquely to the alignment of longitudinal pillar galleries 3, whereby the retreat face is in advance of the remaining retreat face on pillars 2 in the right outer transverse pillar gallery 4 shown in FIGS. 1 to 3, in which drift conveyor 9 is also laid. In addition to the oblique alignment of extraction device 5, which is rectilinear here, a plurality of tubbing units 10, that can be displaced according to requirements and the progress of recovery, are arranged according to the invention both in longitudinal pillar galleries 3 and in inner transverse pillar galleries 4, with which units the roof is supported relative to the floor in longitudinal pillar galleries 3 and transverse pillar galleries 4 between pillars 2. The resetting and displacement of tubbing units 10 take place according to the invention by means of a vehicle 50 that can be moved in pillar galleries 3, 4, which vehicle is provided with a loading platform 51 in a rear section of vehicle 50 for transporting and moving tubbing units 10. As will be explained in greater detail hereafter, the individual tubbing units 10 are displaced in such a manner that tubbing units 10 are folded together or retracted, for displacement, so that they can be moved together with vehicle 50 through other tubbing units 10 set in pillar galleries 3, 4 to their new site, at which they are again set. The other tubbing units 10, if required as a result of system conditions, are now moved, folded together, through the tubbing unit now set.

In FIGS. 1 to 3 a total of eleven tubbing units 10 are used during pillar recovery. As the pillar recovery progresses by advancing extraction device 5 in working direction A, the depth of pillars 2 being worked continuously decreases so that at a certain point tubbing unit 10 arranged in the right inner pillar gallery 4 must be the first to be displaced. Depending on the dimensioning of pillars 2 a single tubbing unit 10 may suffice in each inner pillar gallery 4. Tubbing unit 10 is displaced with vehicle 50 from its initial position in FIG. 1, inside the same inner transverse pillar gallery 4, into the next row of pillars 2, and is set there again (10', FIG. 2). The tubbing unit already displaced between the representations in FIGS. 1 and 2 is denoted by reference number 10' in FIG. 2. FIG. 2 also shows the process of the displacement of the tubbing unit denoted by 10A in FIGS. 1 and 2 by means of vehicle 50 from the initial position to the final position. Here the displacement takes place through tubbing unit 10' already set and the two tubbing units 10B and 10C still set, as illustrated particularly clearly in FIG. 2 by the different positions of vehicle 50. As the recovery progresses, all the other tubbing units 10 are then also moved with vehicle 50 into the next section of the same transverse pillar gallery 4 or into the next longitudinal pillar gallery 3, and are set there (i.e. pressed hydraulically against the roof). In FIG. 3 tubbing unit 10B is moved with vehicle 50 through tubbing unit 10C and tubbing unit 10' set in transverse pillar gallery 4 before it is unloaded in the next longitudinal pillar gallery 3 from the platform of vehicle 50, is laterally extended and then set again. The inward folding, retraction, resetting, extension and resetting of tubbing units 10 continue until all the tubbing units have essentially resumed the initial position shown in FIG. 1, and then take place continuously until all pillars 2 have been worked in working direction A and pillars 2 have been worked in another row with short face extraction device 5.

Figure 4:
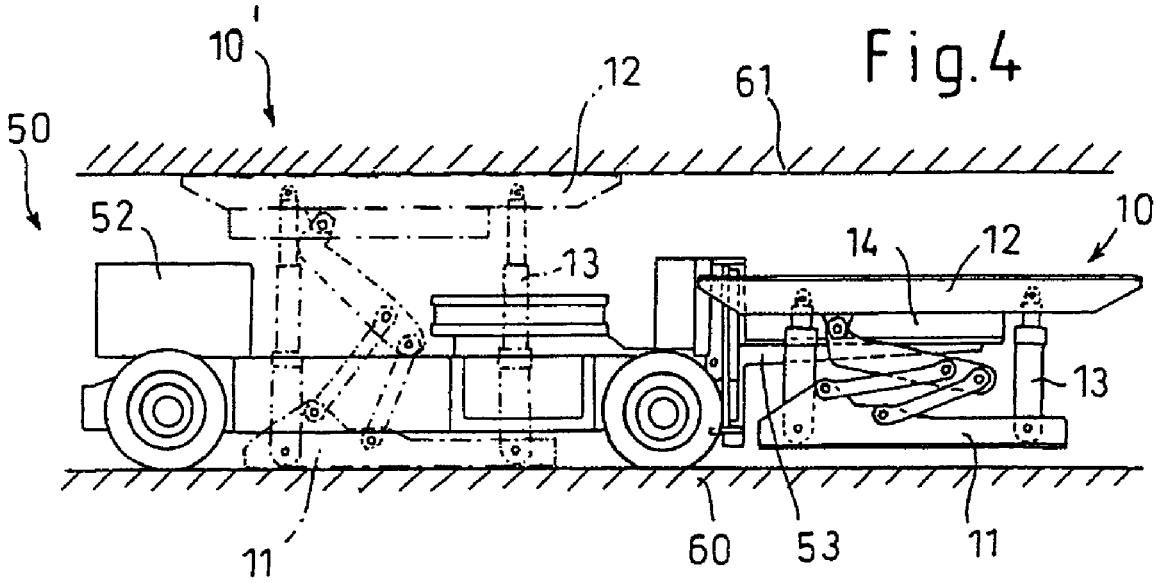
FIG. 4 shows diagrammatically, in a side view, the displacement of a collapsed tubbing unit with a vehicle through another set tubbing unit.

The structure of tubbing units 10 and the displacement of tubbing units 10 by means of vehicle 50 are now explained with reference to FIGS. 4 to 8. FIG. 4 shows how a tubbing unit 10 according to the invention can be moved in the retracted and folded condition by means of a vehicle 50 through an extended and set tubbing unit 10' so that it can be set at another site. As will be explained further hereafter, each tubbing unit 10, 10' comprises two floor runners 11 and two support beams 12 each, which can be adjusted by means of a pair of props 13 between an extended position, in which each floor runner 11, as shown in the case of tubbing unit 10', rests on floor 60 and in which each support beam 12 is pushed against roof 61, and a retracted position, as shown in the case of tubbing unit 10. Tubbing unit 10 can in this case only be conveyed with vehicle 50 in the retracted or folded position, for which purpose vehicle 50 is provided in the rear area with a platform 53 that can be raised and lowered, in the form of a lifting fork, with which platform a transfer frame 14 on tubbing unit 10, which frame is arranged between both support beams 12 and on which they can be swiveled, as will be explained later, can be underrun. Platform 53 can preferably be moved to a lifting height at which it supports transfer frame 14, while support beams 12 are still pressed against roof 61. It is self-evident that the vehicle frame of vehicle 50, provided with motor 52, has a smaller width than the width of the pillar galleries and the width of tubbing units 10' in the extended condition.

Figure 5:
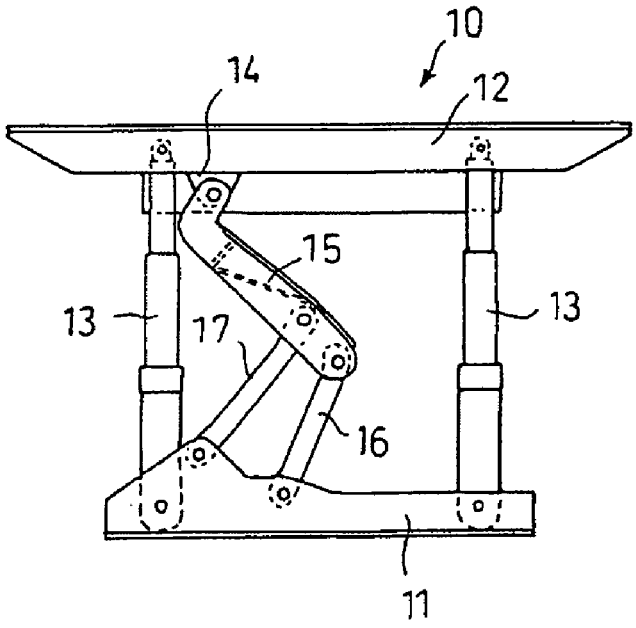
FIG. 5 shows diagrammatically, in a side view, a tubbing unit according to the invention in the set condition.

FIG. 5 shows a tubbing unit 10 when set, in which the hydraulically actuated props 13, which are linked at one end to the floor runners and at the other end to support beams 12, are fully extended and are loaded with the setting pressure of a hydraulic fluid. On the underside of support beam 12 is formed a connecting joint 14 to which a support arm 15 is articulated, which arm is connected by a lemniscate gear comprising two guides 16, 17 to floor runner 11, so that support beam 12 moves permanently parallel with floor runner 11 during the travel movement of props 13. The lemniscate gear formed with guides 16, 17 is arranged between the two props 13 of each support beam 12.

Figure 6:
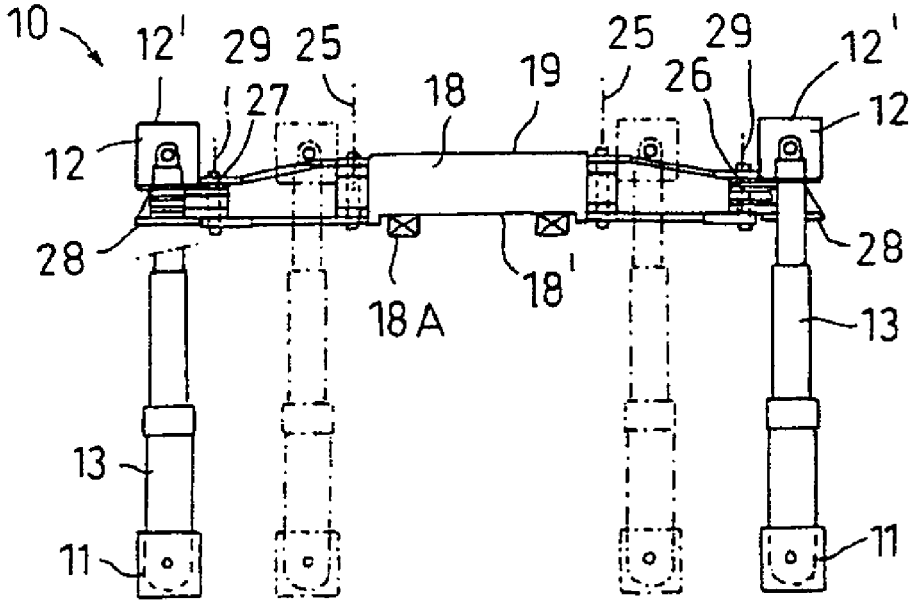
FIG. 6 shows diagrammatically, in a front view, a tubbing unit according to the invention based on a first exemplary embodiment with contracted and extended support beams.
Figure 7:
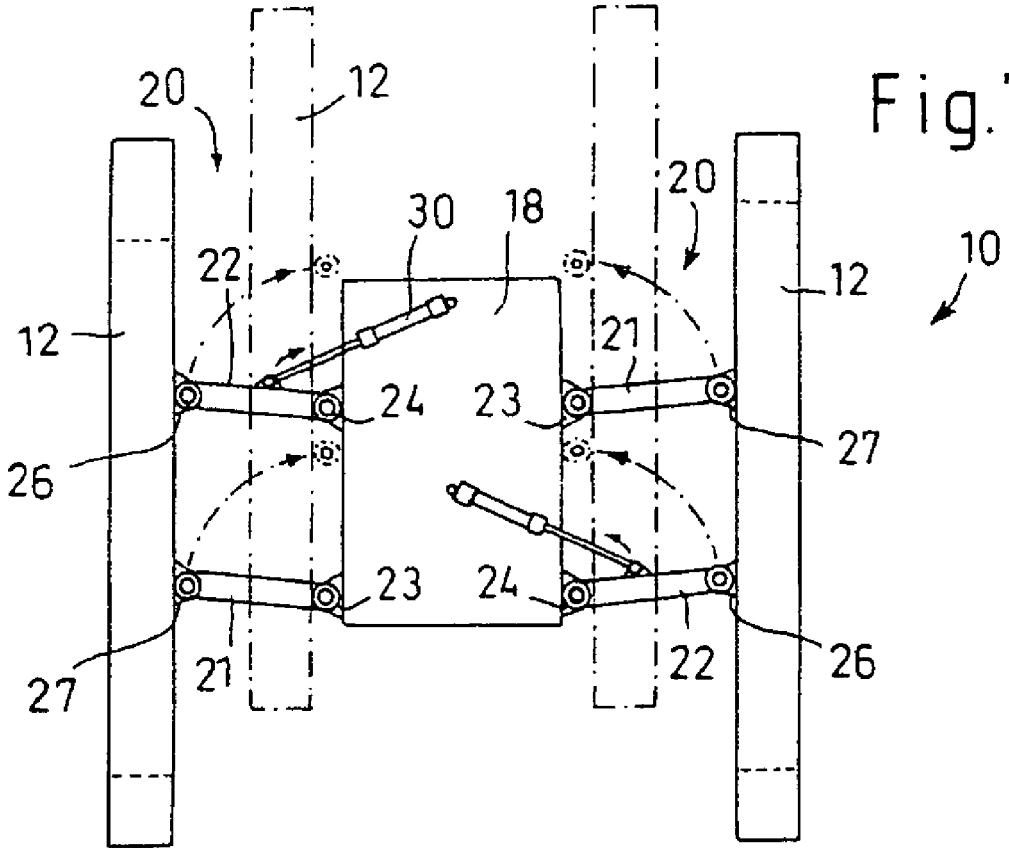
FIG. 7 shows an elevation of the tubbing unit from FIG. 6.
Figure 8:
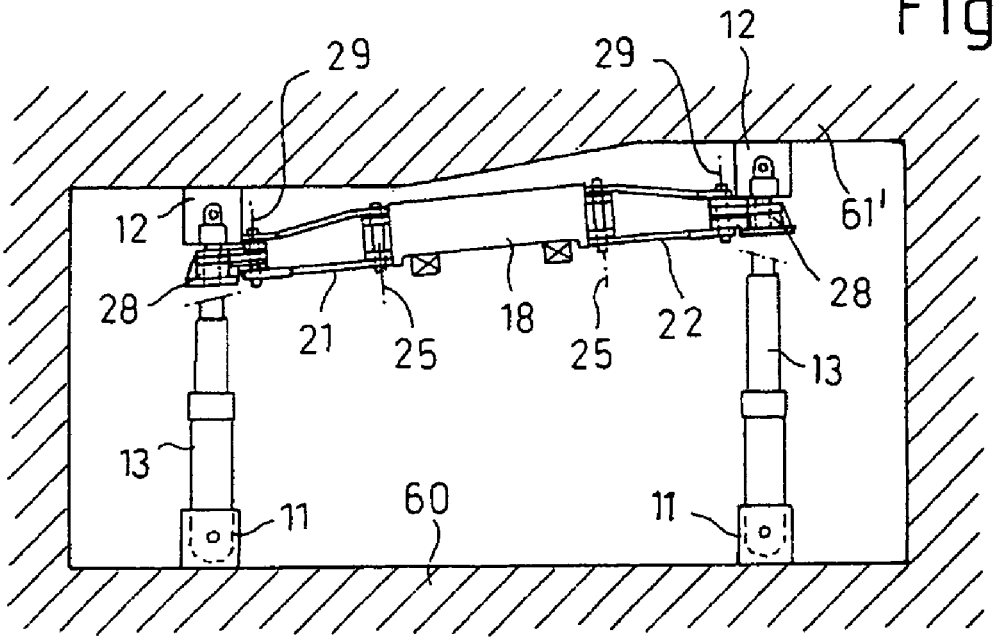
FIG. 8 shows diagrammatically in a side view a tubbing unit according to the invention with props extending to different widths.

As shown in particular in FIGS. 6 and 7, each tubbing unit 10 comprises two groups of floor runners 11, props 13, support beams 12 and lemniscate gears arranged parallel with each other, which gears are arranged on both sides of a central transfer frame 18 whose upper side 19 is lower than upper side 12' of the two support beams 12. The connection between transfer frame 18 and both support beams 12 each consists of a pair of guides 20 of intermediate guides 22 and 21 respectively, which are mounted on the transfer frame side in bearings 23 and 24 respectively on transfer frame 18. Bearings 23, 24 allow a swivel movement of intermediate guides 21, 22 about a swivel axis 25 perpendicular to the flat surface of transfer frame 18. The outer ends of intermediate guides 21, 22 are connected by swivel joints 26 and 27 respectively to a plummer block 28, which is secured tiltably to support beams 12 so that, as shown in FIG. 8, support beams 12 can be extended to different heights in the case of irregularities of the floor or roof 61' when a sloping roof 61' has to be supported. When transfer frame 18 is tilted swivel axes 25 and 29 of the individual swivel bearings 21, 22 and 26, 27 respectively are inclined to the vertical around the corresponding oblique position of tubbing unit 10.

The width of tubbing units 10, as illustrated particularly clearly in FIGS. 6 and 7, can be reduced by swiveling intermediate guides 21, 22 and support beams 12 connected to them. In the minimum width of tubbing units 10, support beams 12 are folded laterally onto the longitudinal sides of transfer frame 18. The adjusting movement of both support beams 12 is effected by adjusting cylinders 30, which are active between transfer frame 18 and one of intermediate guides 22, and in the folded condition of tubbing units 10, when tubbing cylinders 13 have also been moved into the push-in position, a tubbing unit 10 fits through an unfolded and set tubbing unit 10 both in terms of width and height.

Vehicle 50, shown in FIG. 4, is required to displace tubbing units 10, wherein the underside 18' of transfer frame 18 can be provided with special supports 18A or a guide in order to be able to run under transfer frame 18 with platform 53 of vehicle 50, and guarantee safe support of the entire tubbing unit 10 on platform 53.

In the preferred exemplary embodiment shown, tubbing units 10 form passive frames which must be connected for actuating props 13 or adjusting cylinders 30 either to the longwall hydraulics of the extraction device (5, FIGS. 1 to 3) or to suitable hydraulic units which are moved with the vehicle. However, intermediate accumulators could be provided on the tubbing units for intermediately storing the pressure and hydraulic fluid of the props and, if necessary, using it for an adjustment movement of adjusting cylinders 30 so that at least the tubbing units can be inwardly folded and retracted without being connected to the longwall hydraulics.

Figure 9:
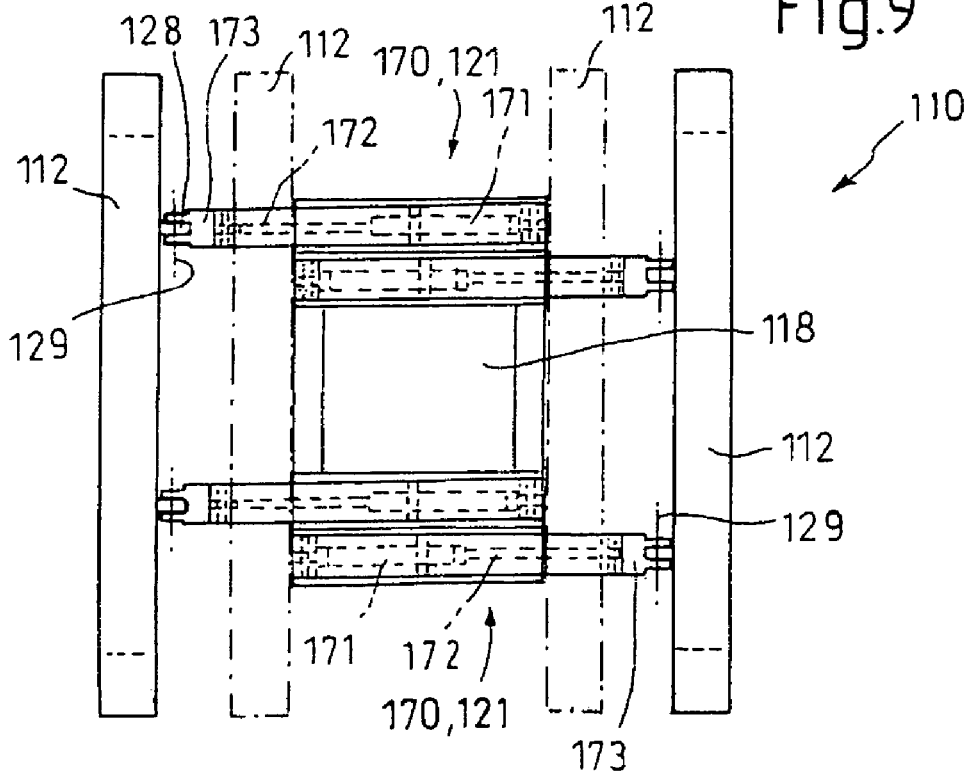
FIG. 9 shows an elevation of a tubbing unit according to a second exemplary embodiment according to the invention with telescopic intermediate guides.

FIG. 9 shows a second exemplary embodiment of a tubbing unit 110 according to the invention. In the case of tubbing unit 110 a transfer frame 118 is arranged centrally between two support beams 112, and the loading platform of a vehicle is able to run under it or it can be supported on a vehicle by other means to enable tubbing unit 110 to be conveyed to another site of installation in the pillar galleries. Just as in the first exemplary embodiment for the tubbing unit 10, both support beams 112 may form one structural unit together with the floor runners, props and lemniscate gear, all of which can be moved relative to transfer frame 118 for widening or retracting the tubbing unit. However, support beams 112 and the corresponding structural unit are moved here by means of a pair of telescopic intermediate guides 221, each of which consists of hydraulically actuated adjusting cylinders 170 with a cylinder 171 secured to the upper side or lateral wall of transfer frame 118, and a piston rod 172 that can be loaded on both sides, the rod head 173 of which is secured indirectly or directly by means of a rocker bearing 128, with a tilting axis 129 lying horizontal or parallel with the plane of the transfer frame, to support beams 112. Since both support beams 112 are movable, a total of four adjusting cylinders 170 are used here. Both support beams 112 can be extended to different heights by means of rocker bearings 128, and here stabilizing means, such as spring loaded clamping cylinders, can be arranged between piston rod heads 173 and support beams 112 in order to stiffen the tubbing unit generally. The upper side of adjusting cylinders 170 should be lower than the upper side of support beams 112.

For the person skilled in the art numerous modifications are evident from the previous description, modifications that will fall under the protection of the dependent claims. In the method according to the invention four or more pillars could also be worked in long face longwall working, or only two pillars could be worked simultaneously. In the case of the tubbing units only one of the support beams could be swiveled to the transfer frame. The number of tubbing units used may be varied according to the application and the ratio of pillar size to pillar gallery width. The transfer frame may consist of a solid plate or a lined longwall structure. The extraction device may also comprise a coal plane. If they still lie adjacent to pillars to be worked, the outer transverse pillar galleries are kept open by suitable measures. The adjusting movement of the tubbing units may also take place by other means. The vehicle may also have a grab, a crane or other lifting device for receiving the tubbing unit for conveying to another site with the vehicle.

The invention claimed is:

1. A movable tubbing unit for pillar recovery in chamber-and-pillar working, comprising:

at least two horizontal support beams separated by a predetermined distance;

at least two floor runners;

a plurality of vertically-adjustable props, at least two of the plurality of vertically-adjustable props being movably attached to each horizontal support beam;

a plurality of intermediate guides;

a transfer frame positioned between the at least two horizontal support beams and movably connected to at least one of the horizontal support beams by at least one intermediate guide; and at least one steering gear positioned between two of the plurality of vertically-adjustable props, the steering gear being directly movably attached to at least one horizontal support beam and directly movably attached to at least one floor runner, wherein each of the vertically adjustable props are operable for vertically extending to move a respective horizontal support beam into contact with a roof in a pillar gallery.

2. The tubbing unit of claim 1, wherein each of the plurality of intermediate guides includes a telescopic adjusting cylinder for adjustment of the horizontal support beam attached to the respective intermediate guide.

3. The tubbing unit of claim 1, wherein each of the plurality of intermediate guides are swiveled with respect to the support beam and the transfer frame.

4. The tubbing unit of claim 3, further comprising:

a hydraulically-adjustable adjusting cylinder arranged between one of the plurality of intermediate guides and the transfer frame.

5. The tubbing unit of claim 1, wherein the transfer frame is movably attached to two horizontal support beams by the plurality of intermediate guides.

6. The tubbing unit of claim 4, wherein at least one of the plurality of props or the adjusting cylinder is connected to one of longwall hydraulics of an extraction device or to a hydraulic unit mounted on a vehicle operable for moving the movable tubbing unit.

7. The tubbing unit of claim 1, further comprising:

a plurality of plummer blocks attached to at least one of the plurality of support beams; and at least one connection joint located on each of the plurality of plummer blocks, the at least one connection joint being located between one of the plurality of intermediate guides and a respective support beam, wherein the plurality of plummer blocks is operable for variable vertical adjustment of the at least two support beams.

8. The tubbing unit of claim 1, wherein the steering gear is a lemniscate gear; and each of the plurality of intermediate guides is a parallel steering gear.

9. The tubbing unit of claim 1, wherein an upper surface of each of the plurality of support beams is higher than an upper surface of the transfer frame.

10. The tubbing unit of claim 1, wherein the transfer frame is adapted to be underrun with a loading platform mounted on a vehicle for moving the movable tubbing unit.

11. The tubbing unit of claim 10, wherein the transfer frame includes one of a guide or a support for the loading platform of the vehicle.

12. The tubbing unit of claim 11, further comprising one of engaging means or engaging pockets located on the transfer frame for a lifting device positioned on the vehicle.

* * * * *